US007093558B1

(12) United States Patent
Mandanici

(10) Patent No.: US 7,093,558 B1
(45) Date of Patent: Aug. 22, 2006

(54) CONVERTIBLE BOAT TOP

(76) Inventor: Glenn Mandanici, 13659 Windsong Way, Palm Beach Gardens, FL (US) 33418

( * ) Notice: Subject to any disclaimer, the term of this patent is extended or adjusted under 35 U.S.C. 154(b) by 0 days.

(21) Appl. No.: 10/978,492

(22) Filed: Nov. 1, 2004

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS

| | | | | |
|---|---|---|---|---|
| 3,698,409 | A | 10/1972 | Koontz et al. | |
| 4,641,600 | A | 2/1987 | Halvorsen | |
| 5,016,558 | A | 5/1991 | Oehler | |
| 5,092,262 | A | 3/1992 | Lacy | |
| 5,303,667 | A | 4/1994 | Zirkelbach et al. | |
| 5,479,872 | A * | 1/1996 | Hulett | 114/361 |
| 5,904,114 | A | 5/1999 | Wright | |
| 5,983,824 | A | 11/1999 | Hernandez | |
| 6,223,680 | B1 | 5/2001 | Frink et al. | |
| 6,357,379 | B1 | 3/2002 | Murphy, Jr. | |
| 6,439,150 | B1 | 8/2002 | Murphy et al. | |
| 2002/0053313 | A1 * | 5/2002 | Murphy et al. | 114/361 |

* cited by examiner

*Primary Examiner*—Stephen Avila
(74) *Attorney, Agent, or Firm*—Gold & Rizvi, P.A.; Glenn E. Gold; H. John Rizvi

(57) ABSTRACT

A convertible boat top which is mounted on a bass or flats type boat and can be selectively deployed in an extended, functional position to cover occupants of the boat and a stowed, storage position on the side of the boat to prevent interference of the boat top with occupants engaged in fishing or other boating activities. The convertible boat top includes a pair of support stanchions for engaging the boat and a pair of attachment stanchions for engaging the boat in spaced-apart relationship to the support stanchions. A retractable boat top is selectively extendable from the support stanchions and removably engages the attachment stanchions to cover and shield occupants in the boat from adverse weather conditions.

16 Claims, 8 Drawing Sheets

CONVERTIBLE BOAT TOP

FIELD OF THE INVENTION

The present invention relates generally to boating accessories for flats boats, bass boats and the like. More particularly, the present invention relates to a novel convertible boat top which is mounted on a boat and can be deployed in a functional, covering configuration to shield occupants of the boat from the sun, rain and other weather, or partially deployed for similar protection of seats, console and/or equipment, and can be retracted to a stowed, non-functional configuration to prevent interference of the boat top with boating activities, as desired.

BACKGROUND OF THE INVENTION

In recent years, boating has become an increasingly popular activity. Some of the most common types of boats include so-called flats boats, which are characterized by a generally flat bottom and upward-standing sides. Multiple seats are typically provided in the boat for seating a driver and one or multiple passengers.

The upward-standing sides of a flats boat define an open top. This provides sufficient access to the boat occupants for the casting of fishing rods, for example, as well as movement in the boat and between the boat and the water when swimming is desired. The open top of the flats boat provides sufficient space for movement of the boat occupants during boating activities, however, it exposes the occupants to incessant heat from the sun in hot, sunny weather, as well as to rain during rainy weather.

Various boat covers are known in the art for covering or shading the cockpit of a boat. For example, U.S. Pat. No. 4,641,600 discloses an extendable and retractable cover for the cockpit of a small boat. The cover incorporates a cover sheet, which is rolled onto a roller disposed across and carried by the transom of the boat. The cover sheet follows fore and aft guides provided along the edges of the sides of the cockpit. A latch and handle mechanism are provided to latch the cover sheet to the windshield. A motor and corresponding circuitry is provided for actuating rolling and unrolling of the cover sheet. The cover is designed particularly to protect the cockpit of the boat when the boat is not in use. Consequently, the cover is not raised during deployment to a height sufficient to cover boat occupants; instead functioning to shield the interior of the boat from the environment when the boat is not occupied or in use. Additionally, the cover is not portable and requires substantial modification to the boat on which it is mounted.

U.S. Pat. No. 6,439,150 B1 discloses a shade cover assembly, which is particularly adapted to be carried on a tower above the cockpit area of a pleasure boat. The cover is extendable and retractable through a slotted elongated cover fixture carried by a tower, transversely to the hull, above the cockpit area of the boat. The cover fixture is carried laterally by side frame members and is adapted to be fastened or tensioned, such as by hooks, to the front frame member. The shade assembly can be extended into a functional configuration or stowed to a non-functional configuration. However, the cover is incapable of being stowed to one side of the boat to permit free movement of occupants in the boat when not in use.

U.S. Pat. Nos. 5,303,667 and 5,904,114 disclose boat covers that include a folding support frame assembly spanned by a flexible cover or canopy. The support frame assembly is relatively complex and has multiple parts.

Additional boat covers are disclosed in U.S. Pat. Nos. 3,698,409; 5,092,262; 5,983,824; 6,223,680; 6,357,379. Each of the boat covers is relatively bulky, complex and/or is incapable of being efficiently selectively deployed in a functional position to cover occupants of a boat or stowed to one side of the boat when not in use. Moreover, none of the patents discloses a portable covering which is particularly adapted for use with bass or flats types of boats. Furthermore, none of the patents discloses a flexible covering that is maintained in a spring-loaded, rolled configuration supported by a pair of stanchions along one side of a vessel in a stowed position and extendible across the width of the vessel for attachment to a corresponding pair of stanchions along an opposite side of the vessel.

SUMMARY OF THE INVENTION

The invention is directed to a convertible boat top mounted on a bass boat, or other flats-type boat, and can be selectively deployed in an extended, functional position, to cover occupants of the boat, or partially extended for seat, console and equipment protection, or fully stowed in a storage position on the side of the boat to prevent interference of the boat top with occupants engaged in fishing or other boating activities, as desired. The convertible boat top includes a pair of vertically-adjustable support stanchions provided on the gunwale on one side (i.e., port or starboard side) of the boat, and a corresponding pair of attachment stanchions provided on the gunwale on the opposite side of the boat. An elongated, cylindrical panel housing is attached to the support stanchions. A spring-loaded, retractable cover panel extendible from a rolled configuration in the panel housing is attached to the attachment stanchions to provide a cover for occupants in the boat. The cover panel can be detached from the attachment stanchions and retracted back into the panel housing and the stanchions stowed in a retracted configuration when use of the convertible boat top is not desired.

In one general aspect of the present invention, a convertible boat top is provided for selectively covering and shielding occupants of a boat from the sun or inclement weather conditions, and uncovering the occupants in a non-hindering fashion when use of the convertible boat top is not desired. The convertible boat top typically comprises:

a pair of support stanchions provided on one side of a boat;

a pair of attachment stanchions provided on an opposite side of the boat; and a retractable cover panel which is extendable from the support stanchions to the attachment stanchions to cover occupants of the boat.

In a further aspect of the present invention, the support stanchions and attachment stanchions can be stowed in a collapsed or retracted configuration when the convertible boat top is not in use.

In still a further aspect of the present invention, each support stanchion and each attachment stanchion includes middle and top segments, which are telescopically extendible from a bottom segment.

In yet another aspect of the present invention, the retractable cover panel is extendible from a rolled configuration inside an elongated, cylindrical panel housing which is attached to the support stanchions, and the extending end of the cover panel is removably attached to the attachment stanchions when deployed in a functional, covering configuration.

In another aspect of the present invention, the convertible boat top is portable.

In a still further aspect of the present invention, each support stanchion and attachment stanchion contains one or more compression springs for maintaining each stanchion in the fully-extended, functional position.

In yet another aspect of the present invention, one or more of the support stanchions incorporates, in lieu of springs, a detent locking mechanism for maintaining the stanchion(s) in a fully-extended functional position.

In yet another aspect of the present invention, the convertible boat cover has a simple, low cost construction, and requires relatively minimal effort and know-how to operate.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention is generally directed to a convertible boat top which is mounted on a boat, such as a flats-type boat or bass boat, and can be selectively deployed in an extended, functional configuration to shield boat occupants from the sun, rain or other weather conditions or deployed in a stowed, non-functional configuration to provide sufficient space for boating activities by the boat occupants. The convertible boat top has a design that incorporates an uncomplicated, easy-to-install construction, provides portability, is easy to operate and is relatively inexpensive to manufacture.

Figure 1:
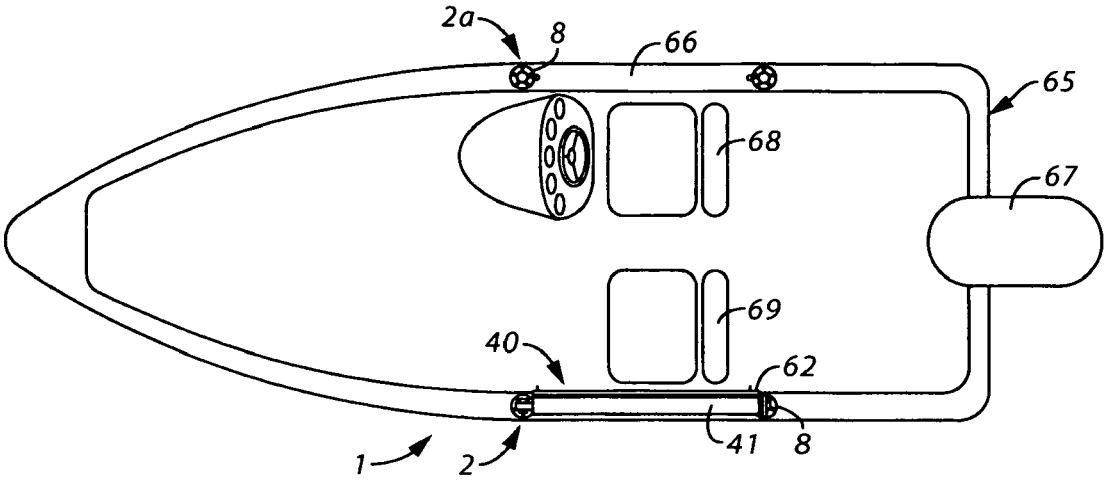
FIG. 1 is a top view of a boat, with the convertible boat top of the present invention mounted on the boat and the retractable cover panel disposed in a partially stowed, non-functional configuration.
Figure 2:
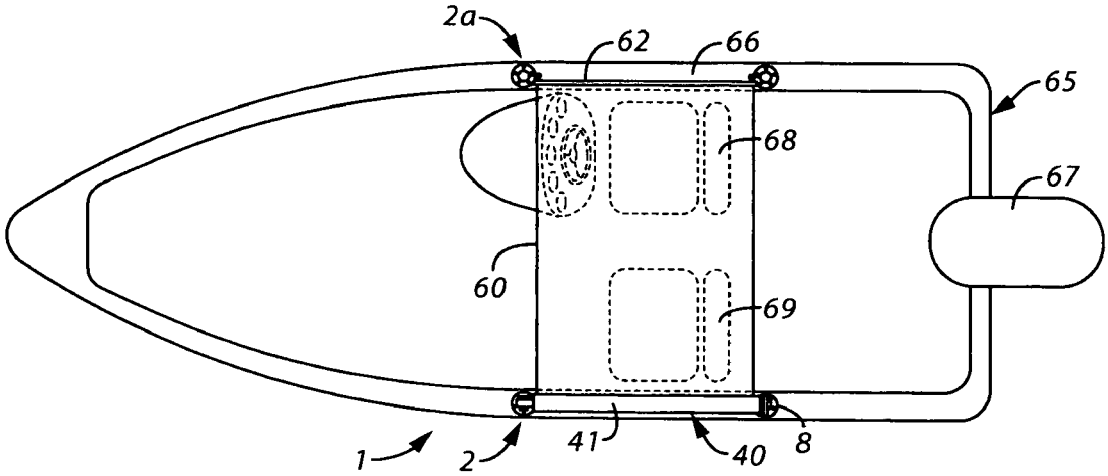
FIG. 2 is top view of the boat of FIG. 1, with the retractable cover panel of the convertible boat top shown in the deployed, extended, functional configuration.
Figure 3:
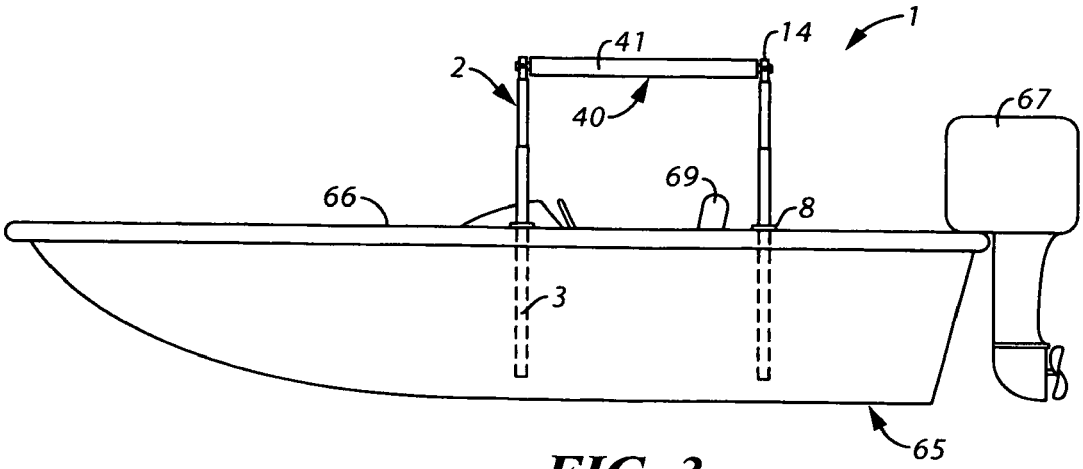
FIG. 3 is a left side view of the boat of FIGS. 1 and 2, illustrating a side view of the functionally-deployed convertible boat top.

Referring initially to FIGS. 1–3, a preferred embodiment of the convertible boat top of the present invention is generally indicated by reference numeral 1. The convertible boat top 1 is configured for mounting on a boat 65, which is typically a flats-type boat such as, for example, a bass-fishing boat. The boat 65 typically includes a gunwale (or gunnel) 66, a motor 67, a driver's seat 68 and a passenger's seat 69. Briefly, the convertible boat top 1 includes a pair of support stanchions 2 mounted on the gunwale 66 on one side of the boat 65, and a pair of corresponding attachment stanchions 2*a* mounted on the gunwale 66 on the opposite side of the boat. A retractable boat top 40 includes a panel housing 41 supported by the support stanchions 2. A spring-loaded, retractable cover panel 60 can be selectively extended from a rolled configuration in the panel housing 41 and removably attached to the attachment stanchions 2*a* to cover the driver's seat 68 and the passenger seat 69, for example, as illustrated in FIG. 2 and as hereinafter further described. Furthermore, the retractable cover panel 60 can be selectively detached from the attachment stanchions 2*a* and retracted into the panel housing 41 when use of the convertible boat top 1 is not desired, as illustrated in FIG. 1.

Figure 7:
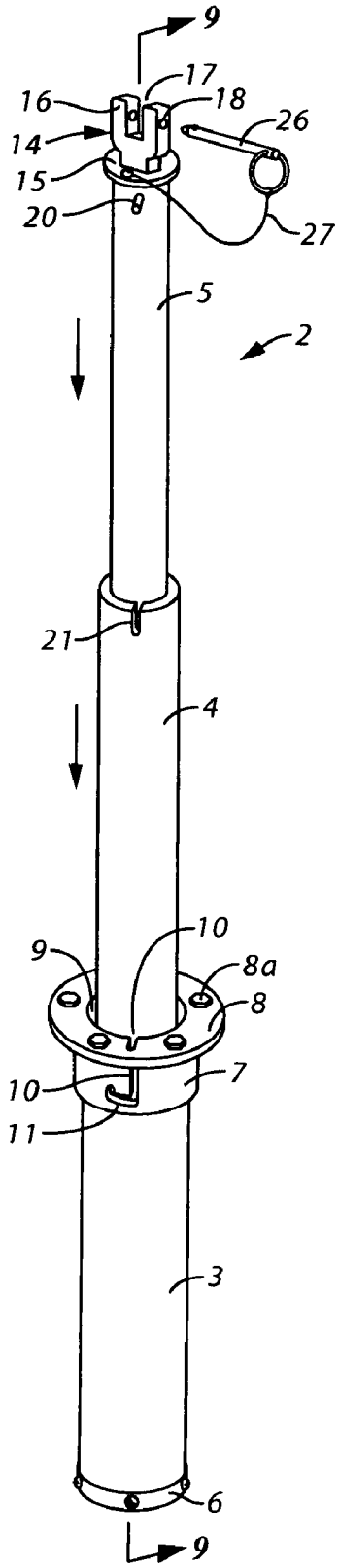
FIG. 7 is a perspective view of a support stanchion deployed in the fully-extended, functional configuration.
Figure 8:
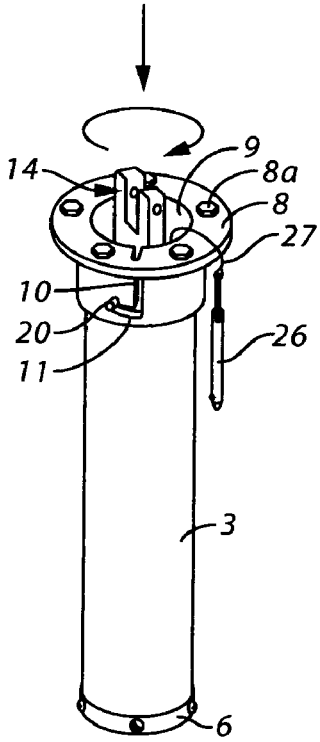
FIG. 8 is a perspective view of a support stanchion deployed in the retracted, non-functional configuration.
Figure 9:
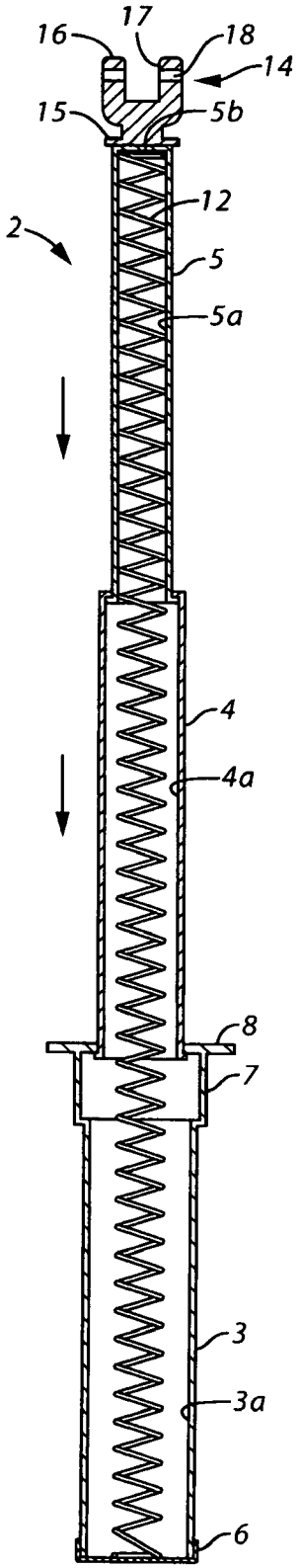
FIG. 9 is a longitudinal sectional view of the fully-extended support stanchion, taken along section lines 9—9 in FIG. 7.
Figure 9A:
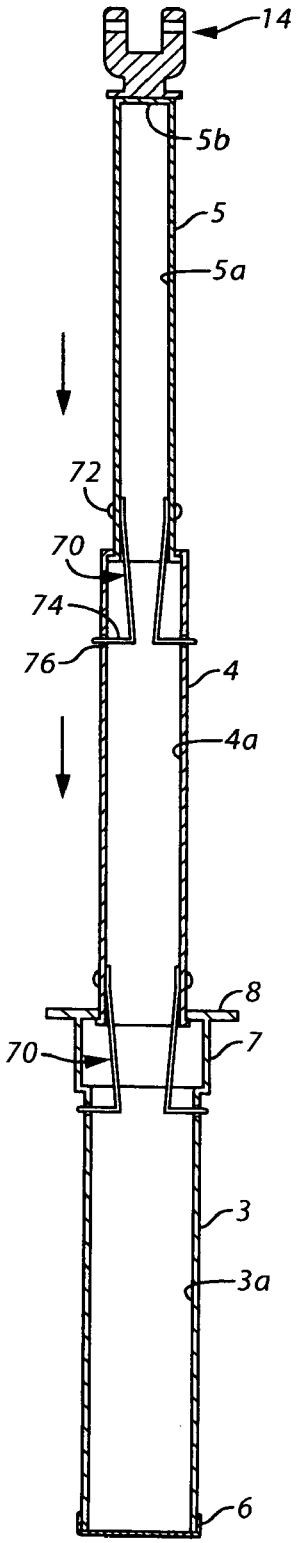
FIG. 9A is a longitudinal sectional view of the fully-extended support stanchion, taken along section lines 9—9 in FIG. 7, illustrating an alternative stanchion locking mechanism.
Figure 10:
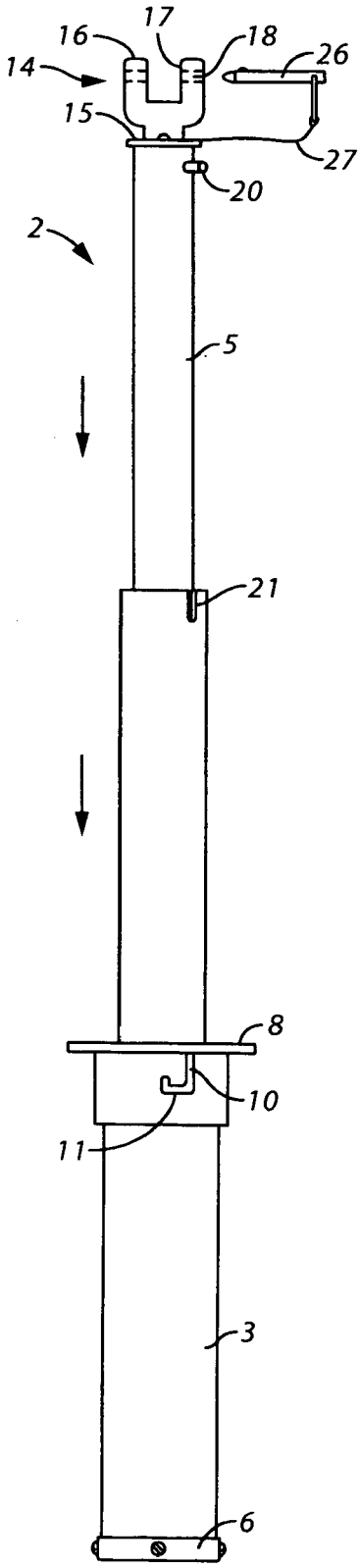
FIG. 10 is a side view of a fully-extended support stanchion.
Figure 11:
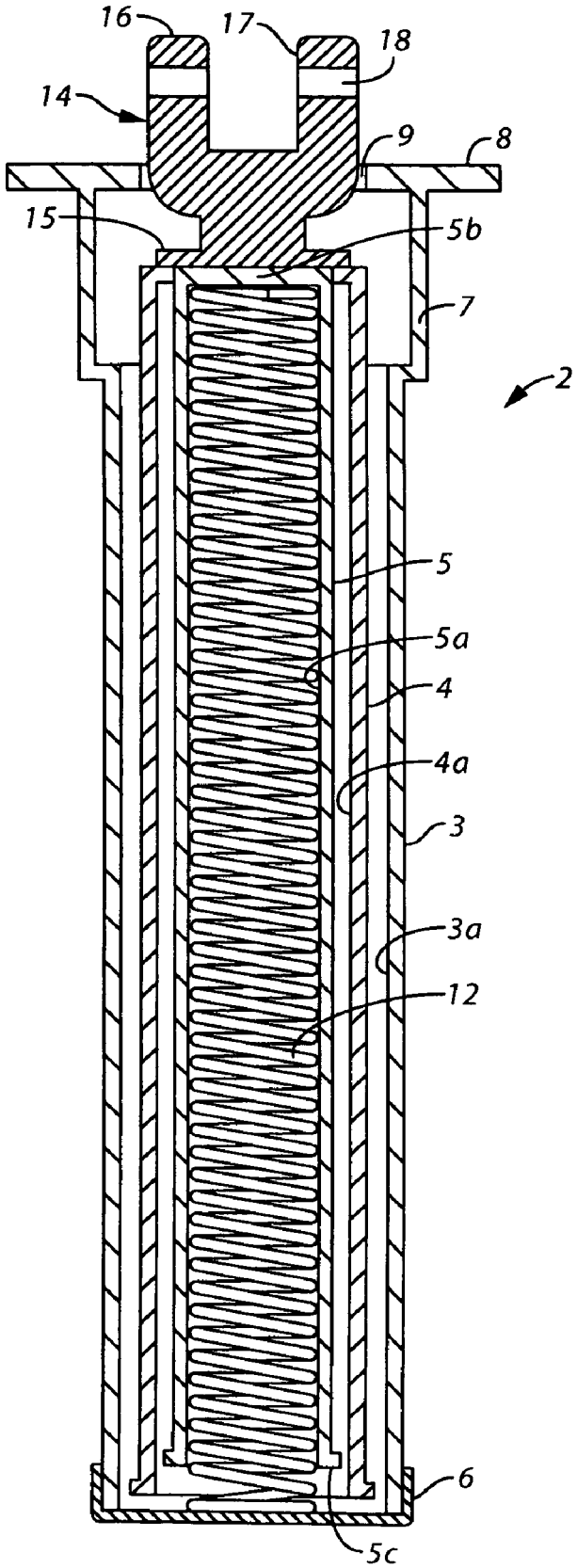
FIG. 11 is a longitudinal sectional view of a support stanchion disposed in the non-functional, retracted configuration of FIG. 8.
Figure 12:
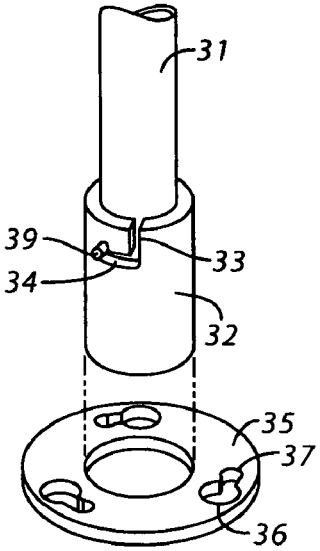
FIG. 12 is a perspective view, partially in section, of a stanchion shaft, base collar and base flange elements of an alternative embodiment of a support stanchion and attachment stanchion according to the present invention.
Figure 14:
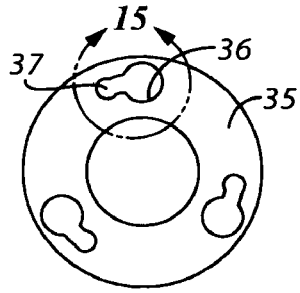
FIG. 14 is a top view of the base flange element of the alternative embodiment support stanchion.

Referring next to FIGS. 7–11, each support stanchion 2 typically includes an elongated, tubular bottom segment 3 having an interior 3*a*, as illustrated in FIGS. 9 and 9A. A bottom cap 6 closes the bottom end of the bottom segment 3. An elongated, tubular middle segment 4 having an interior 4*a* is telescopically extendible from the interior 3*a* of the bottom segment 3. Similarly, an elongated, tubular top segment 5 having an interior 5*a* is telescopically extendible from the interior 4*a* of the middle segment 4. As illustrated in FIG. 11, the top segment 5 includes a closed upper end 5*b* and an open bottom end 5*c*. As illustrated in FIG. 9, a coiled compression spring 12 is provided in the interior 3*a*, 4*a*, 5*a* of the bottom segment 3, middle segment 4 and top segment 5, respectively. The compression spring 12 normally maintains the support stanchion 2 in the fully-extended configuration shown in FIG. 9 when the convertible boat top 1 is deployed in the functional, covering configuration, as hereinafter further described. As will be apparent to those skilled in the art, multiple individual smaller compression springs could be used in lieu of the single compression spring 12 depicted in FIG. 9. In that case, both the middle segment 4 and upper segment 5 would preferably include a bottom cap (not shown) similar to bottom cap 6 of bottom segment 3.

As illustrated in FIG. 9A, in an alternate embodiment of the invention, the compression spring 12 (or multiple compression springs), can be replaced by biased detent members 70 having upper ends permanently attached to upper tubular member 5 and middle tubular member 4 by fasteners 72. Outwardly biased lower segments 74 of detent members 70 are configured for being received through corresponding tube apertures 76. In this manner, the individual tubular members of the stanchions can be selectively locked into an extended position during use. Likewise, the ends 74 of the detent members can be manually disengaged to enable the telescoping tubular members to be retracted, or collapsed, into a stowed position.

A collar 7 encircles the bottom segment 3, adjacent to the upper end thereof. An annular collar flange 8, having a central flange opening 9, extends outwardly from the collar 7. The collar flange 8 is provided with multiple bolt openings (not shown), which receive respective bolts 8*a* for securing the support stanchion 2 to the gunwale 66 (FIG. 2) of the boat 65. A retainer pin slot 10, having a horizontal segment 11, extends through the wall of the collar 7. A retainer pin 20 extends from the top segment 5 of the support stanchion 2, adjacent to the upper end thereof. A retainer slot 21 is provided in the upper end of the middle segment 4 to enable complete, or full, retraction. Accordingly, as illustrated in FIG. 8, each support stanchion 2 can be retracted from the fully-extended, functional configuration of FIG. 7 to the retracted, non-functional configuration of FIG. 8 by telescopically retracting the top segment 5 into the middle segment 4 and the middle segment 4 into the bottom segment 3, against the bias exerted by the compression spring 12 (FIG. 9). As the top segment 5 is retracted into the middle segment 4, the retainer pin 20 is inserted into the retainer slot 21. As the middle segment 4 is retracted into the bottom segment 3, the retainer pin 20 is inserted downwardly into the retainer pin slot 10 and the top segment 5 is rotated in the clockwise direction, for example, as illustrated by the curved arrow in FIG. 8, to locate the retainer pin 20 in the horizontal segment 11 of the retainer pin slot 10. Accordingly, as long as it remains inserted in the horizontal segment 11 of the retainer pin slot 10, the retainer pin 20 maintains the support stanchion 2 in the retracted configuration of FIG. 8. The support stanchion 2 can subsequently be deployed in the extended, functional configuration by rotation of the top segment 5 in the counterclockwise direction to remove the retainer pin 20 from the horizontal segment 11. This enables the extension spring 12 to extend the middle segment 4 from the bottom segment 3 and the top segment 5 from the middle segment 4.

A clevis 14 is provided on the closed upper end 5*b* of the top segment 5. The clevis 14 typically includes a clevis base 15 which is mounted on the closed upper end 5*b* of the top segment 5 and includes a pair of upward-standing clevis flanges 16. A clevis opening 17 is defined between the clevis flanges 16. Registering pin openings 18 are provided in the respective clevis flanges 16. A quick release lock pin 26, the purpose of which will be hereinafter described, is typically connected to the clevis base 15 of the clevis 14 by a lanyard 27.

Figure 5A:
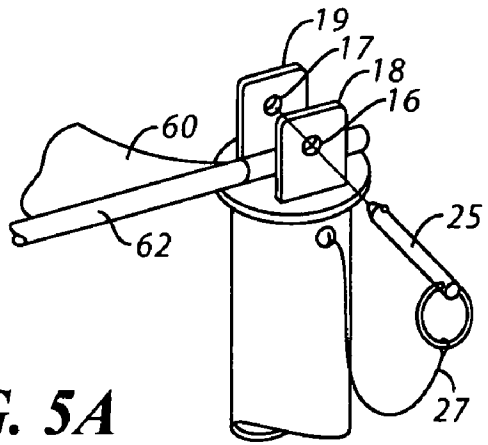
FIG. 5*a* is a perspective view, partially in section, of a top portion of an alternate embodiment the attachment stanchion of FIG. 5, with the retractable cover panel (partially in section) deployed in the functional configuration and the extended end of the retractable cover panel removably attached to the attachment stanchion.
Figure 5:
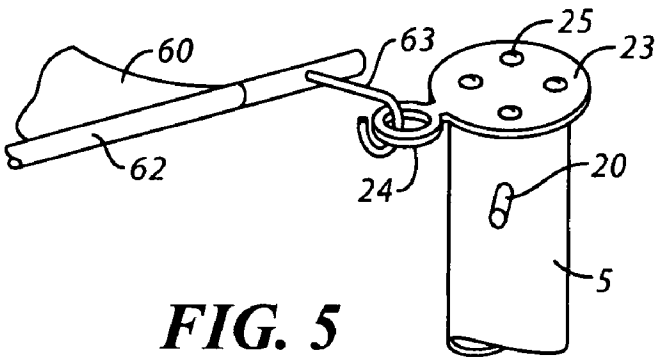
FIG. 5 is a perspective view, partially in section, of a top portion of an attachment stanchion, with the retractable cover panel (partially in section) deployed in the functional configuration and the extended end of the retractable cover panel removably attached to the attachment stanchion.

Referring next to FIG. 5, each attachment stanchion 2*a* is similar in design to the support stanchion 2, except the clevis 14 of the support stanchion 2 is replaced by an attachment cap 23 which is attached to the upper end of the top segment 5 typically using multiple screws 25. An attachment ring 24 extends from the attachment cap 23, for purposes which will be hereinafter described.

Referring next to FIG. 5A, in a further aspect of the present invention, attachment cap 23 is provided having a pair of generally planar rigid tabs, 18 and 19, extending upwardly therefrom in spaced-apart relationship, the tabs having corresponding aligned apertures, 16 and 17, extending therethrough. Furthermore, a lock pin 25, secured to stanchion segment 5 by lanyard 27, is sized for being received through the apertures 16, 17 for releasable locking engagement with tabs 18, 19. The tab and locking pin arrangement are provided in lieu of the attachment ring 24, for purposes hereinafter described.

Figure 4:
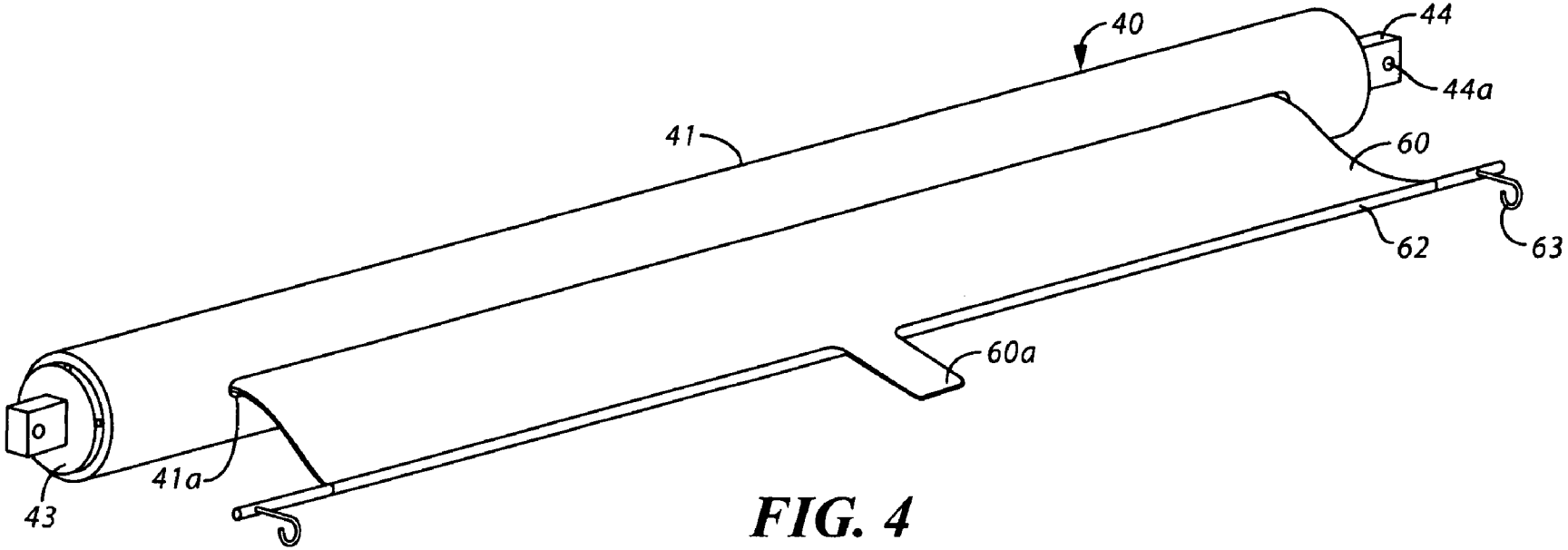
FIG. 4 is a perspective view of the retractable boat top element of the convertible boat top, with the retractable cover panel partially extended from the panel housing element of the retractable boat top.
Figure 6:
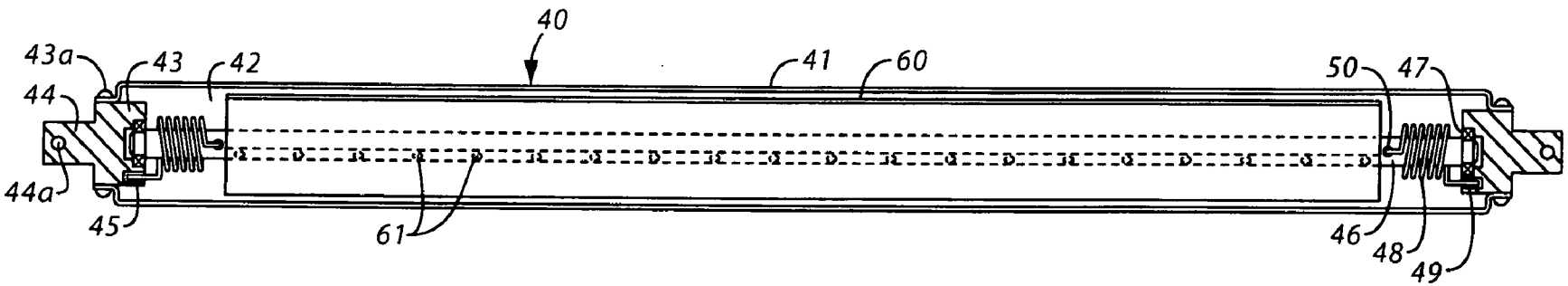
FIG. 6 is a longitudinal sectional view of the retractable boat top element of the convertible boat top.

Referring next to FIGS. 4 and 6, the retractable boat top 40 typically includes an elongated, cylindrical panel housing 41 having a housing interior 42 (FIG. 6). A typically cylindrical rod mount block 43 is mounted in each end of the panel housing 41, typically using screws 43*a*, for example. A rectangular block extension 44 extends outwardly from each rod mount block 43. A pin opening 44*a*, the purpose of which will be hereinafter described, extends through each block extension 44. A rod recess 45 in each rod mount block 43 faces the housing interior 42 of the panel housing 41. An elongated panel support rod 46 spans the housing interior 42, and each end of the panel support rod 46 is seated in the rod recess 45 of the corresponding rod mount block 43. Ball or composite bearings 47 may be interposed between the panel support rod 46 and the rod mount block 43 to facilitate smooth rotation of the panel support rod 46 in the rod recesses 45 of the rod mount block 43. One end of a torsion spring 48 is inserted in a spring notch 49 provided in each rod mount block 43. The torsion spring 48 winds around the panel support rod 46, and the opposite end of the torsion spring 48 is inserted in a spring opening 50 provided in the panel support rod 46. Accordingly, each torsion spring 48 resists rotation of the panel support rod 46, typically in conventional fashion.

As illustrated in FIG. 6, one end of a retractable cover panel 60 is attached to the panel support rod 46 typically using multiple rivets 61. The retractable cover panel 60 extends from an elongated panel slot 41*a* provided in the panel housing 41, as illustrated in FIG. 4. As further illustrated in FIG. 4, an elongated panel attachment rod 62 is attached to the end of the retractable cover panel 60, which extends from the panel slot 41*a*. Referring particularly to FIG. 5, each of a pair of panel attachment hooks 63 typically extends forwardly from the panel attachment rod 62, adjacent to a corresponding end thereof. Due to the tensioning effect of the torsion springs 48 on the panel support rod 46, the retractable cover panel 60 is normally wound on the panel support rod 46 in the housing interior 42, with the retractable cover panel 60 extending through the panel slot 41*a*, as illustrated in FIG. 4. A pull tab 60*a* typically extends from the retractable cover panel 60, beyond the panel attachment rod 62, to facilitate extending the retractable cover panel 60 from the panel housing 41, against the bias applied by the torsion springs 48. Referring briefly to FIG.

5*a*, in an alternate embodiment of the invention, each end of the panel attachment rod 62 is positioned and maintained Referring again to FIGS. 1–11, in typical application of the invention, the convertible boat top 1 is mounted on the boat 65. Accordingly, the support stanchions 2 are mounted on the gunwale 66 on one side of the boat 65, whereas the corresponding attachment stanchions 2*a* are mounted on the gunwale 66 on the opposite side of the boat 65. Each support stanchion 2 and attachment stanchion 2*a* is attached to the gunwale 66 typically by extending bolts 8*a* (FIG. 7) through bolt openings (not shown) provided in the collar flange 8 and threading the bolts 8*a* into respective bolt openings (not shown) provided in the gunwale 66. As illustrated in FIG. 3, the bottom segment 3 of each support stanchion 2 and attachment stanchion 2*a* typically extends through an opening (not shown) provided in the gunwale 66 and extends beneath the gunwale.

Each support stanchion 2 and attachment stanchion 2*a* is extended from the non-functional, retracted configuration of FIG. 8 to the fully-extended, functional configuration of FIGS. 3 and 7 by rotating the retainer pin 20 from the horizontal segment 11 of the retainer pin slot 10, as heretofore described. This enables the extension spring 12 (FIG. 9) to extend the middle segment 4 from the bottom segment 3 and the top segment 5 from the middle segment 4, respectively. Next, the retractable boat top 40 is mounted on the support stanchions 2. This is accomplished by seating each block extension 44 (FIG. 4) of the retractable boat top 40 in the clevis opening 17 (FIG. 7) of each clevis 14. The lock pin 26 is then extended through the pin openings 18 in the clevis flanges 16 and through the registering pin opening 44*a* of the corresponding block extension 44 to removably mount the retractable boat top 40 on the support stanchions 2. With the support stanchions 2 and attachment stanchions 2*a* mounted on the boat 65 and the retractable boat top 40 mounted in place on the support stanchions 2, the convertible boat top 1 is in a partially-stowed, non-functional configuration as shown in FIG. 1.

The convertible boat top 1 is deployed to the extended, functional configuration illustrated in FIG. 2 by extending the retractable cover panel 60 from the panel housing 41, against the bias exerted against the panel support rod 46 by the torsion springs 48 (FIG. 6). As illustrated in FIG. 5, each panel attachment hook 63 removably engages the attachment ring 24 on the corresponding attachment stanchion 2*a*. Accordingly, the retractable cover panel 60 remains in the extended, functional position of FIG. 2 as long as the panel attachment hooks 63 remain attached to the attachment rings 24 on the respective attachment stanchions 2*a*. As illustrated in FIG. 2, in the functional configuration, the retractable cover panel 60 extends above the driver's seat 68 and the passenger's seat 69 to shield a driver and passenger (not illustrated) seated in the boat 65 from the sun or from rain or other inclement weather.

The retractable cover panel 60 can be stowed to the non-functional configuration of FIG. 1, as desired, by disengaging the panel attachment hooks 63 from the attachment rings 24 on the respective attachment stanchions 2*a*. This causes the spring-loaded panel support rod 46 (FIG. 6), biased by the torsion springs 48, to rotate and retract the retractable cover panel 60 back into the panel housing 41 through the panel slot 41*a* (FIG. 4). Accordingly, the convertible boat top 1 returns to the partially-stowed, non-functional position of FIG. 1 such that occupants (not illustrated) in the boat 65 are capable of moving about the boat 65 during fishing or other boating activities without hindrance from the deployed retractable cover panel 60. The retractable boat top 40 can be completely detached from the support stanchions 2 and stored elsewhere in the boat. Then the support stanchions 2 and attachment stanchions 2*a* can each be retracted from the extended, functional position illustrated in FIG. 3 to the retracted position in FIG. 8, as desired, by telescopically extending the top segment 5 into the middle segment 4 and the middle segment 4 into the bottom segment 3 against tension exerted by the extension spring 12, and then locating the retainer pin 20 in the horizontal segment 11 of the retainer pin slot 10. Accordingly, when each support stanchion 2 and attachment stanchion 2*a* is disposed in the collapsed, non-functional configuration of FIGS. 8 and 11, the clevis 14 is situated in the flange opening 9 of the collar flange 8. In this manner, the convertible boat top 1 is in a fully-stowed condition such that neither the stanchions 2, 2*a* nor boat top 40 present a hindrance to boat occupants.

An alternative design for each support stanchion is generally indicated by reference numeral 30 in FIGS. 12–15. Each attachment stanchion (not illustrated) according to the alternative design is the same as that of the support stanchion 30, except that the clevis 14 is replaced by the attachment cap 23 (FIG. 5). The alternative design for each support stanchion 30 and attachment stanchion renders the convertible boat top 1 portable. Accordingly, the support stanchion 30 according to the alternative design includes an elongated stanchion shaft 31 having a clevis 14 mounted on the upper end thereof. The stanchion shaft 31 of the support stanchion 30 is removably mounted in a base collar 32, having a retainer pin slot 33 with a horizontal segment 34. An annular base flange 35 extends from the base collar 32. Multiple bolt openings 36 extend through the base flange 35, and a bolt notch 37 in the base flange 35 communicates with each bolt opening 36. Multiple mount bolts 38 are threaded in respective bolt openings (not illustrated) provided in the gunwale 66 of the boat 65, with the head 38*a* of each mount bolt 38 extending above the surface of the gunwale 66. A retainer pin 39 extends from the stanchion shaft 31, adjacent to the lower end thereof.

Figure 15:
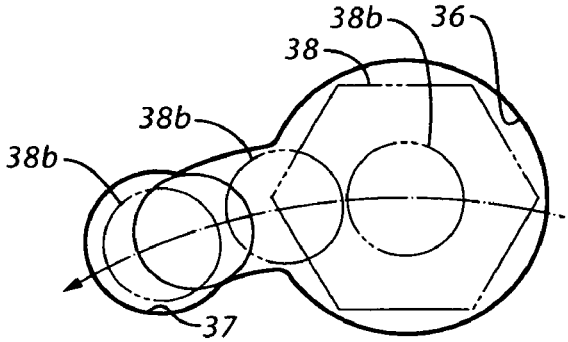
FIG. 15 is a schematic view illustrating rotation of the base flange to locate each of multiple mount bolts from a corresponding bolt opening to a narrowed bolt notch in the base flange to removably mount the alternative embodiment support stanchion on the boat.
Figure 13:
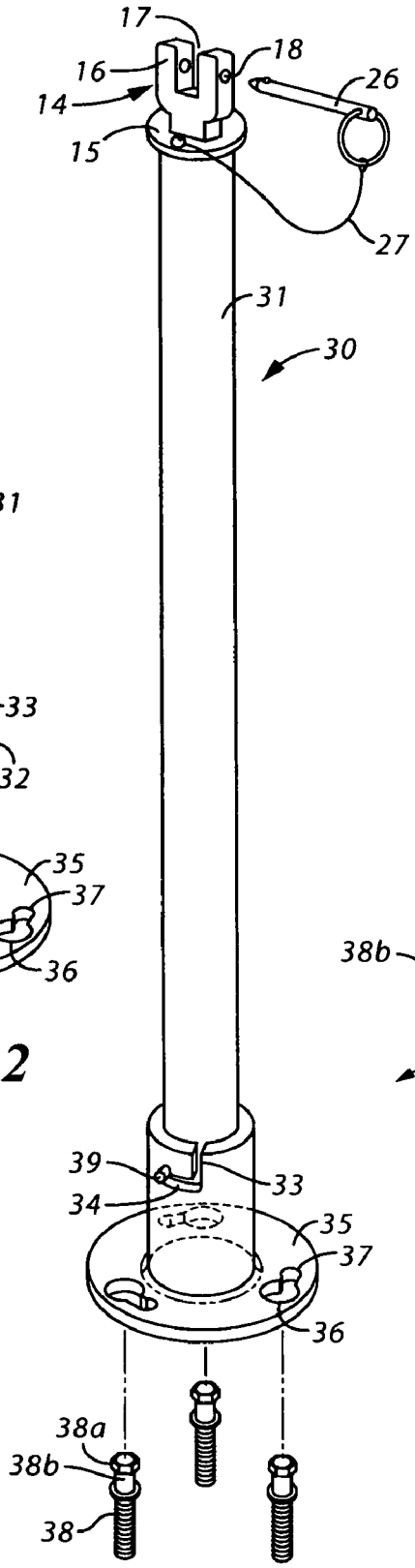
FIG. 13 is a partially-exploded, perspective view of the alternative embodiment support stanchion, more particularly illustrating a preferred, bolt technique for removably mounting the support stanchion on a gunwale of a boat.

The base flange 35 is removably mounted on the gunwale 66 by initially extending the head 38*a* of each mount bolt 38 through the corresponding bolt opening 36 in the base flange 35. The base flange 35 is then rotated in the clockwise direction to friction-fit the neck 38*b* of each mount bolt 38 in the adjacent bolt notch 37, as illustrated in FIG. 15. The stanchion shaft 31 is removably mounted in the base collar 32 by inserting the lower end of the stanchion shaft 31 in the base collar 32 while lowering the retainer pin 39 downwardly through the vertical segment of the retainer pin slot 33, and then rotating the stanchion shaft 31 clockwise to locate the retainer pin 39 in the horizontal segment 34 of the retainer pin slot 33. Each support stanchion 30 and attachment stanchion (not illustrated) is assembled in the same manner on opposite sides of the boat 65, and the retractable boat top 40 (FIG. 4) is mounted on the support stanchions 30 in the same manner as the support stanchions 2 and attachment stanchions 2*a* heretofore described. It will be appreciated by those skilled in the art that the support stanchion 30 can be disassembled by removing the stanchion shaft 31 from the base collar 32 and disengaging the base flange 35 from the mount bolts 38 by reversing the assembly steps described above. Furthermore, the support stanchion 30 can be mounted with other support stanchions 30 and attachment stanchions on a second boat (not illustrated) provided with the bolts 38 to facilitate use of the convertible boat top 1 on the boat.

Figure 16:
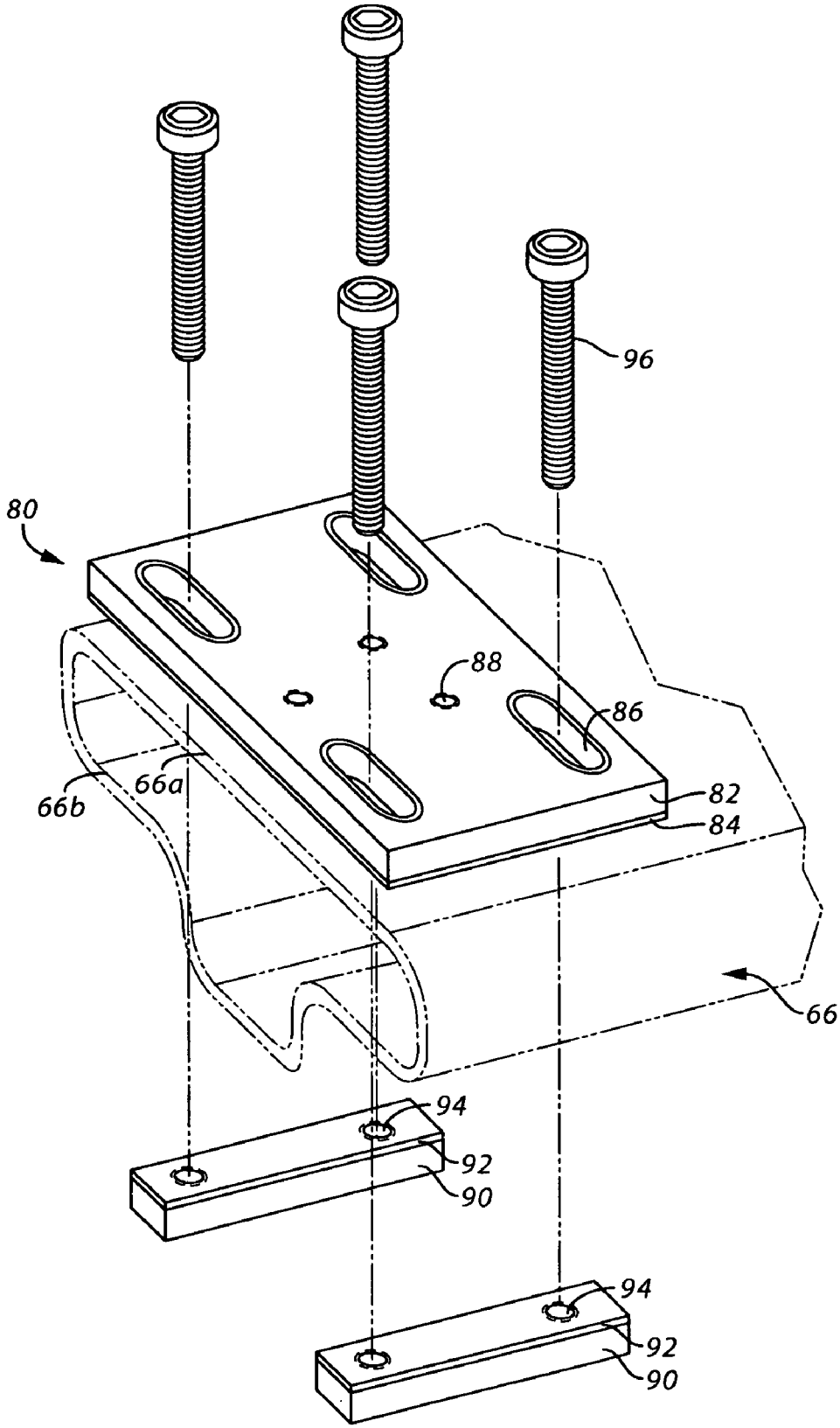
FIG. 16 is a partially sectioned, exploded view of an alternate stanchion support apparatus, particularly configured for use with boats having inner and outer flanged gunnels.

Referring now particularly to FIG. 16, in a further aspect of the present invention, a clamping apparatus, shown generally as reference numeral 80, is provided for securing the support and attachment stanchions of the present invention to a flanged boat gunwale 66. The clamping apparatus 80 includes a rigid upper clamp plate 82 having a resilient planar gasket layer 84 disposed on its bottom surface, and a pair of rigid lower clamping members 90 each having a resilient planar gasket layer 92 disposed on an upper surface thereof. In order to secure the clamping apparatus to the boat gunwale, threaded fasteners 96 are provided extending through elliptical openings 86 in upper plate 82 (and resilient layer 84), through corresponding aligned apertures (not shown) in upper and lower gunwale walls, 66*a* and 66*b*, respectively, and finally through corresponding aligned threaded apertures 94 in lower clamping members 90 (and resilient layers 92). Once the clamping mechanism 80 has been securely installed against the gunwale, bolts 38 (FIG. 13) are received into corresponding threaded apertures 88 in upper clamping plate 82, for mounting support (and/or attachment) stanchions 30 thereto, as previously described with regard to FIGS. 12–15.

While the preferred embodiments of the invention have been described above, it will be recognized and understood that various modifications can be made in the invention and the appended claims are intended to cover all such modifications which may fall within the spirit and scope of the invention.

What is claimed is:

1. A convertible boat top for a boat, comprising:

a pair of support stanchions for engaging the boat;

a pair of clevises provided on said pair of support stanchions, respectively;

a pair of attachment stanchions for engaging the boat in spaced-apart relationship to said pair of support stanchions;

a pair of attachment rings carried by said pair of attachment stanchions, respectively; and a retractable boat top selectively extendable from said pair of support stanchions for removably engaging said pair of attachment rings on said pair of attachment stanchions, respectively.

2. The convertible boat top of claim 1 wherein said pair of support stanchions and said pair of attachment stanchions each comprises a bottom segment, a middle segment telescopically extendable from said bottom segment and a top segment telescopically extendable from said middle segment.

3. The convertible boat top of claim 2 further comprising a compression spring provided in each of said pair of support stanchions and said pair of attachment stanchions for normally maintaining said each of said pair of support stanchions and said pair of attachment stanchions in an extended configuration.

4. The convertible boat top of claim 3 further comprising a collar carried by said bottom segment, a retainer pin slot provided in said collar, and a retainer pin carried by said top segment for removably engaging said retainer pin slot and selectively retaining said pair of support stanchions and said pair of attachment stanchions, respectively, in a retracted configuration.

5. The convertible boat top of claim 1 wherein said retractable boat top comprises an elongated panel housing having a pair of block extensions for engaging said pair of clevises, respectively, on said pair of support stanchions, respectively; and a retractable cover panel extendible from said panel housing for removably engaging said pair of attachment rings.

6. The convertible boat top of claim 5 further comprising an elongated panel support rod rotatably carried by said panel housing and at least one torsion spring carried by said panel housing and engaging said panel support rod, and wherein said retractable cover panel is carried by said panel support rod.

7. The convertible boat top of claim 6 wherein said pair of support stanchions and said pair of attachment stanchions each comprises a bottom segment, a middle segment telescopically extendable from said bottom segment and a top segment telescopically extendable from said middle segment.

8. The convertible boat top of claim 7 further comprising a compression spring provided in each of said pair of support stanchions and said pair of attachment stanchions for normally maintaining said each of said pair of support stanchions and said pair of attachment stanchions in an extended configuration.

9. A convertible boat top for a boat, comprising:

a pair of support stanchions for engaging the boat, said pair of support stanchions each including a bottom segment, a middle segment telescopically extendable from said bottom segment and a top segment telescopically extendable from said middle segment;

a pair of attachment stanchions for engaging the boat in spaced-apart relationship to said pair of support stanchions, said pair of attachment stanchions including a bottom segment, a middle segment telescopically extendable from said bottom segment and a top segment telescopically extendable from said middle segment;

a compression spring provided in each of said pair of support stanchions and said pair of attachment stanchions for normally maintaining each of said pair of support stanchions and said pair of attachment stanchions in an extended configuration; and a retractable boat top selectively extendable from said pair of support stanchions for removably engaging said pair of attachment stanchions.

10. The convertible boat top of claim 9 further comprising a collar carried by said bottom segment, a retainer pin slot provided in said collar and a retainer pin carried by said top segment for removably engaging said retainer pin slot and selectively retaining said pair of support stanchions and said pair of attachment stanchions, respectively, in a retracted configuration.

11. A convertible boat top for a boat, comprising:

a pair of support stanchions for engaging the boat;

a pair of attachment stanchions for engaging the boat in spaced-apart relationship to said pair of support stanchions;

a retractable boat top selectively extendable from said pair of support stanchions for removably engaging said pair of attachment stanchions, said retractable boat top comprising an elongated panel housing for engaging said pair of support stanchions and a retractable cover panel extendible from said panel housing for removable engaging said pair of attachment stanchions; and an elongated panel support rod rotatably carried by said panel housing and at least one torsion spring carried by said panel housing and engaging said panel support rod, and wherein said retractable cover is carried by said panel support rod.

12. The convertible boat top of claim 11 wherein said pair of support stanchions and said pair of attachment stanchions each comprises a bottom segment, a middle segment telescopically extendable from said bottom segment and a top segment telescopically extendable from said middle segment.

13. The convertible boat top of claim 12, further comprising a compression spring provided in each of said pair of support stanchions and said pair of attachment stanchions for normally maintaining said each of said pair of support stanchions and said pair of attachment stanchions in an extended configuration.

14. A convertible boat top for a boat, comprising:

a plurality of base flanges for removably engaging the boat, each base flange comprising a plurality of bolt openings and a plurality of bolt notches communicating with said plurality of bold openings, respectively, for receiving a plurality of bolts, respectively, provided on the boat;

a pair of support stanchions for removably engaging a first pair of said base flanges, respectively;

a pair of attachment stanchions for removably engaging a second pair of said base flanges in spaced-apart relationship to said pair of support stanchions; and a retractable boat top selectively extendable from said pair of support stanchions for removably engaging said pair of attachment stanchions.

15. The convertible boat top of claim 14 further comprising a plurality of base collars carried by said plurality of base flanges for removably engaging said pair of support stanchions and said pair of attachment stanchions, respectively.

16. The convertible boat top of claim 15, further comprising a plurality of retainer pin slots provided in said plurality of base collars, respectively, and a plurality of retainer pins carried by said pair of support stanchions and said pair of attachment stanchions, respectively, for removably engaging said plurality of retainer pin slots, respectively.

* * * * *